US009500063B2

(12) United States Patent
Greenan

(10) Patent No.: US 9,500,063 B2
(45) Date of Patent: Nov. 22, 2016

(54) HYDRAULIC CYCLE OPENING SLEEVE

(71) Applicant: TAM International, Inc., Houston, TX (US)

(72) Inventor: Iain Greenan, Houston, TX (US)

(73) Assignee: TAM INTERNATIONAL, INC., Houston, TX (US)

( * ) Notice: Subject to any disclaimer, the term of this patent is extended or adjusted under 35 U.S.C. 154(b) by 652 days.

(21) Appl. No.: 13/963,147

(22) Filed: Aug. 9, 2013

(65) Prior Publication Data

US 2015/0041148 A1 Feb. 12, 2015

(51) Int. Cl.

| | |
|---|---|
| ***E21B 34/10*** | (2006.01) |
| ***E21B 34/14*** | (2006.01) |
| ***E21B 34/00*** | (2006.01) |

(52) U.S. Cl.

CPC ..... *E21B 34/102* (2013.01); *E21B 34/00* (2013.01); *E21B 34/103* (2013.01); *E21B 34/14* (2013.01); *E21B 2034/007* (2013.01)

(58) Field of Classification Search

CPC .... E21B 34/10; E21B 34/102; E21B 34/103; E21B 34/14

See application file for complete search history.

(56) References Cited

U.S. PATENT DOCUMENTS

| | | | | |
|---|---|---|---|---|
| 4,429,747 | A * | 2/1984 | Williamson, Jr. | E21B 34/14 166/321 |
| 5,024,273 | A * | 6/1991 | Coone | E21B 33/127 166/154 |
| 7,284,619 | B2 * | 10/2007 | Stokley | E21B 33/146 166/142 |
| 2010/0314562 | A1 * | 12/2010 | Bisset | E21B 34/06 251/12 |
| 2011/0139433 | A1 | 6/2011 | Jackson et al. | |
| 2012/0125627 | A1 | 5/2012 | George et al. | |
| 2012/0279723 | A1 * | 11/2012 | Hofman | E21B 34/063 166/373 |
| 2013/0056206 | A1 | 3/2013 | Jackson et al. | |

OTHER PUBLICATIONS

International Search Report and Written Opinion issued in International Application No. PCT/US2014/048809, dated Nov. 14, 2014 (7 pages).

* cited by examiner

*Primary Examiner* — Nicole Coy
*Assistant Examiner* — Tara Schimpf
(74) *Attorney, Agent, or Firm* — Adolph Locklar

(57) ABSTRACT

According to one aspect of the disclosure, a hydraulic cycle opening sleeve includes a valve assembly and an opening assembly. The valve assembly includes at least one valve chamber and valve piston positioned to move in response to fluid pressure. The opening assembly includes a sliding piston to selectively open or close the hydraulic cycle opening sleeve.

14 Claims, 8 Drawing Sheets

HYDRAULIC CYCLE OPENING SLEEVE

TECHNICAL FIELD/FIELD OF THE DISCLOSURE

The present disclosure relates to downhole tools for providing a communication path from the inside of an inner tubular to the annular area between the inner tubular and an outer tubular or an uncased borehole wall, for stimulation or production.

BACKGROUND OF THE DISCLOSURE

Fracturing sleeves are common devices used in a downhole wellbore to provide a flow path for stimulation or other fluids from inside the completion string or tubular to the formation outside the tubular and/or to allow production of well fluids from the formation into the tubular. Typically fracturing sleeves are either ball actuated, RFID actuated, or pressure-actuated, and can open a single sleeve or many sleeves at a time.

SUMMARY

Embodiments of the present disclosure include a hydraulic cycle opening sleeve. The hydraulic cycle opening sleeve includes a valve collar, the valve collar being a generally tubular member, the valve collar including a first valve cylinder formed in the wall of the valve collar, the first valve cylinder including a first cycling port, a first actuating port, and a first output port; the valve collar including an opening port. The hydraulic cycle opening sleeve also includes a first valve piston positioned to slide within the first valve cylinder in response to fluid pressure introduced into the first valve cylinder through the first cycling port, the first valve piston positioned to fluidly disconnect the first actuating port and the first output port when the first valve piston is in the run in and test positions and positioned to allow fluid connection between the first actuating port and the first output port when the first valve piston is in the open position, the output port fluidly coupled directly or indirectly to the opening port. The hydraulic cycle opening sleeve further includes a first lock rod positioned substantially within the first valve cylinder, the first lock rod coupled to the first valve piston, the first lock rod including at least one locking feature positioned to retain the first valve piston in the open position once first valve piston is in the open position, the first lock rod including a shear pin hole positioned to accept a first shear pin coupled to the valve collar, the first shear pin adapted to resist movement of the first valve piston until a selected fluid pressure introduced into the first valve cylinder through the first cycling port causes the first shear pin to shear. The hydraulic cycle opening sleeve also includes a first valve spring positioned within the first valve cylinder positioned to bias the first valve piston into the open position. The hydraulic cycle opening sleeve also includes a generally tubular mandrel coupled to the valve collar forming a continuous fluidly connected bore, the mandrel including an aperture from its interior to its exterior. The hydraulic cycle opening sleeve also includes a generally tubular port housing coupled to the valve collar, the port housing defining an opening cylinder between an inner wall of the port housing and the exterior cylindrical surface of the mandrel, the opening cylinder fluidly coupled to the opening port of the valve collar, the port housing including an aperture from its interior to the surrounding wellbore positioned to substantially align with the aperture of the mandrel. The hydraulic cycle opening sleeve further includes an opening piston positioned to slide about the mandrel, the piston positioned to slide within the opening cylinder in response to fluid pressure within the opening cylinder when fluid pressure is introduced therein via the opening port of the valve collar, the opening piston including at least one piston aperture, the body of the opening piston positioned to selectively disconnect the aperture of the mandrel from the aperture of the port housing when in the run-in position, thereby preventing fluid communication between the bore of the mandrel and the surrounding wellbore, and the aperture of the opening piston in substantial alignment with the apertures of the mandrel and the port housing when in the open position thereby allowing fluid communication between the bore of the mandrel and the surrounding wellbore.

Other embodiments of the present disclosure include a method including providing a downhole tubular, the downhole tubular including a hydraulic cycle opening sleeve. The hydraulic cycle opening sleeve includes The hydraulic cycle opening sleeve includes a valve collar, the valve collar being a generally tubular member, the valve collar including a first valve cylinder formed in the wall of the valve collar, the first valve cylinder including a first cycling port, a first actuating port, and a first output port; the valve collar including an opening port. The hydraulic cycle opening sleeve also includes a first valve piston positioned to slide within the first valve cylinder in response to fluid pressure introduced into the first valve cylinder through the first cycling port, the first valve piston positioned to fluidly disconnect the first actuating port and the first output port when the first valve piston is in the run in and test positions and positioned to allow fluid connection between the first actuating port and the first output port when the first valve piston is in the open position, the output port fluidly coupled directly or indirectly to the opening port. The hydraulic cycle opening sleeve further includes a first lock rod positioned substantially within the first valve cylinder, the first lock rod coupled to the first valve piston, the first lock rod including at least one locking feature positioned to retain the first valve piston in the open position once first valve piston is in the open position, the first lock rod including a shear pin hole positioned to accept a first shear pin coupled to the valve collar, the first shear pin adapted to resist movement of the first valve piston until a selected fluid pressure introduced into the first valve cylinder through the first cycling port causes the first shear pin to shear. The hydraulic cycle opening sleeve also includes a first valve spring positioned within the first valve cylinder positioned to bias the first valve piston into the open position. The hydraulic cycle opening sleeve also includes a generally tubular mandrel coupled to the valve collar forming a continuous fluidly connected bore, the mandrel including an aperture from its interior to its exterior. The hydraulic cycle opening sleeve also includes a generally tubular port housing coupled to the valve collar, the port housing defining an opening cylinder between an inner wall of the port housing and the exterior cylindrical surface of the mandrel, the opening cylinder fluidly coupled to the opening port of the valve collar, the port housing including an aperture from its interior to the surrounding wellbore positioned to substantially align with the aperture of the mandrel. The hydraulic cycle opening sleeve further includes an opening piston positioned to slide about the mandrel, the piston positioned to slide within the opening cylinder in response to fluid pressure within the opening cylinder when fluid pressure is introduced therein via the opening port of the valve collar, the opening piston including at least one piston aperture, the body of the opening piston positioned to selectively disconnect the aperture of the mandrel from the aperture of the port housing when in the run-in position, thereby preventing fluid communication between the bore of the mandrel and the surrounding wellbore, and the aperture of the opening piston in substantial alignment with the apertures of the mandrel and the port housing when in the open position thereby allowing fluid communication between the bore of the mandrel and the surrounding wellbore. The method further includes running the downhole tubular into a wellbore. The method further includes pressurizing the bore of the downhole tubular in a first pressure test cycle, so that the first valve piston shears the first shear pin, causing the first valve piston to move from the run in position to the test position. The method further includes bleeding the pressure from the bore of the downhole tubular, so that the first valve spring forces the first valve piston into the open position, and the first locking feature retains the first valve piston in the open position. The method further includes pressurizing the bore of the downhole tubular, so that fluid flows through the first actuating port, the first valve cylinder, the first output port, and the opening port so that the opening piston moves into the open position.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
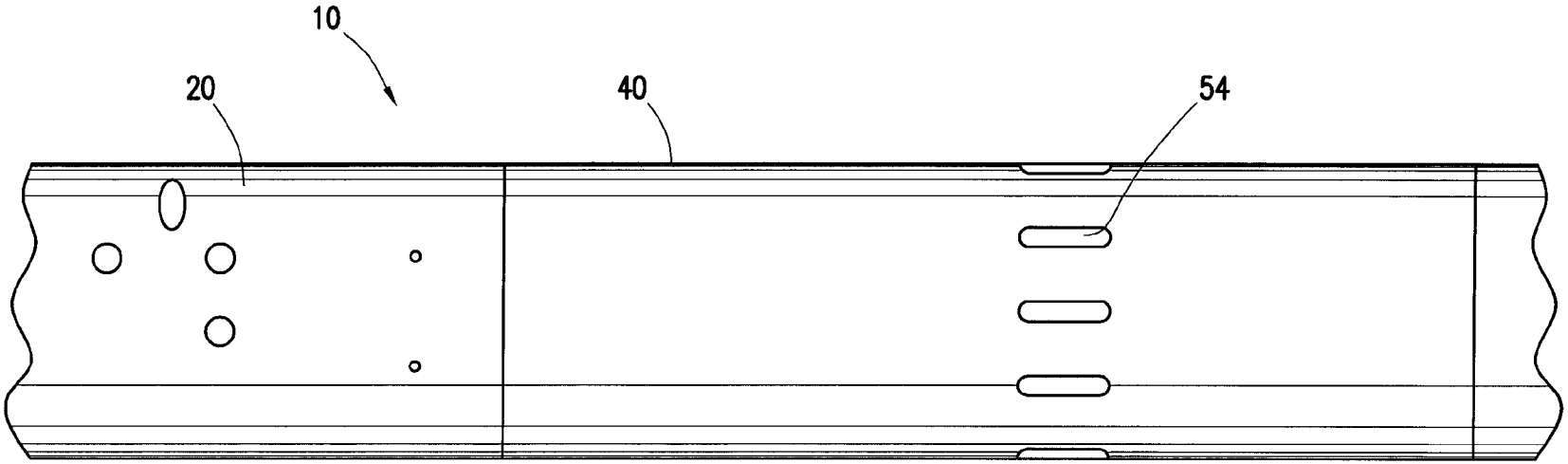
FIG. 1 is an elevation view of a hydraulic cycle opening sliding sleeve consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 illustrates a hydraulic cycle opening sleeve 10 consistent with embodiments of this disclosure. Hydraulic cycle opening sleeve 10 includes a valve collar 20, and an opening assembly 40. Hydraulic cycle opening sleeve 10 may be included as part of a well tubular string (not shown). One having ordinary skill in the art with the benefit of this disclosure will understand that the well tubular string may be a production string, casing string, tubing string, or any other suitable tubular member for use in a wellbore, and may have multiple components including, without limitation, tubulars, valves, packers, etc. without deviating from the scope of this disclosure. One having ordinary skill in the art with the benefit of this disclosure will understand that the opening assembly 40 described herein is intended as an example, and any pressure activated tubular opening assembly may be substituted without deviating from the scope of this disclosure.

Figure 2A:
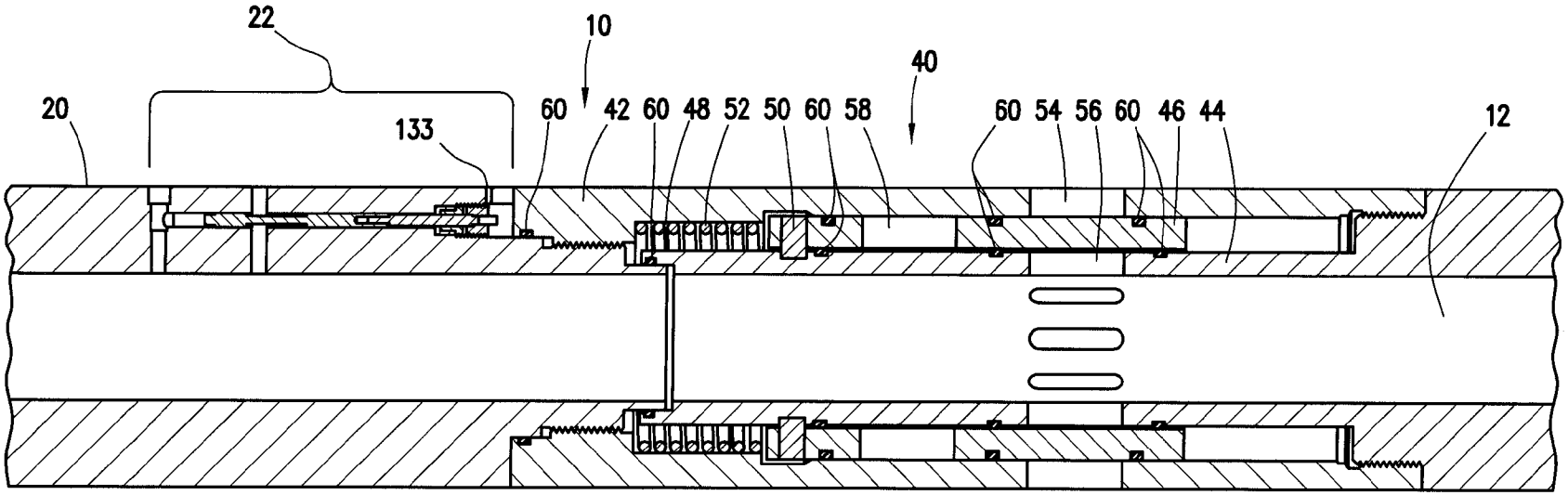
FIG. 2A is a cross-section view of the hydraulic cycle opening sleeve of FIG. 1 in a closed position.
Figure 2B:
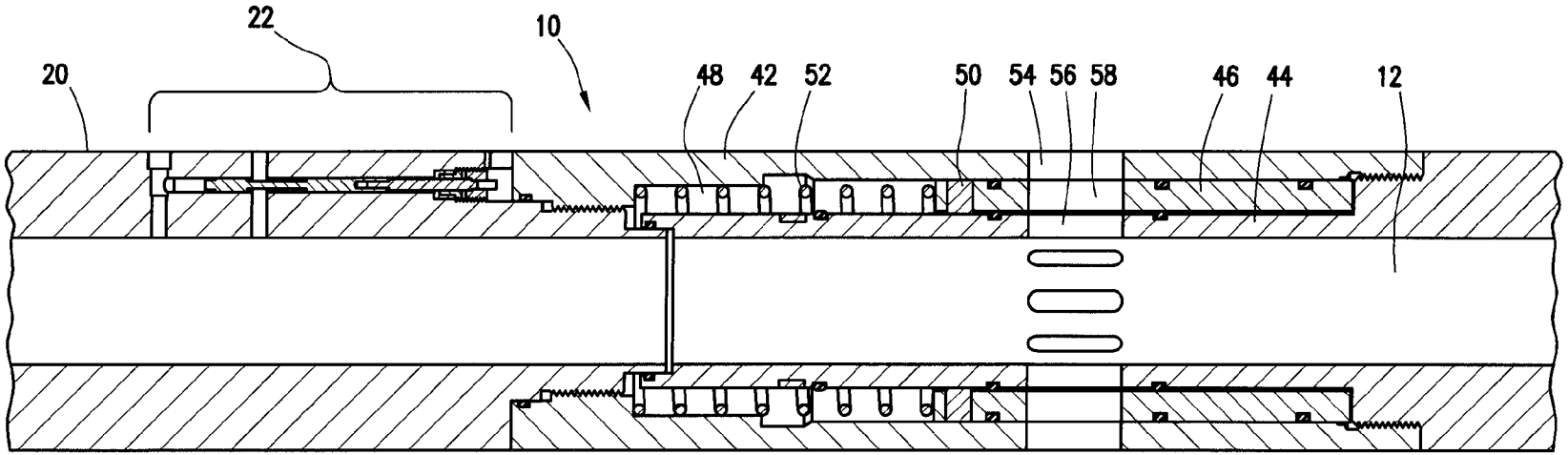
FIG. 2B is a cross-section view of the hydraulic cycle opening sleeve of FIG. 1 in an open position.

FIGS. 2A, 2B depict valve collar 20 coupled to opening assembly 40. Opening assembly 40 includes port housing 42, mandrel 44, and opening piston 46. Port housing 42 and mandrel 44 may be coupled to form opening cylinder 48. Opening piston 46 is positioned to slide along an outer surface of the generally tubular mandrel 44 within the generally tubular port housing 42 in response to, for example, an increase in pressure within opening cylinder 48. In some embodiments, at least one retainer, here depicted as shear bolt 50, may be positioned to temporarily retain opening piston 46 in the closed position depicted in FIG. 2A. Additionally, spring 52 may be positioned within opening cylinder 48 to bias opening piston 46 into the open position depicted in FIG. 2B once shear bolt 50 is sheared. Spring 52 may also keep opening piston 46 in the open position after a decrease in pressure within the opening cylinder 48.

Port housing 42, mandrel 44, and opening piston 46 each include at least one aperture 54, 56, 58 (respectively) positioned to align when opening piston 46 is in the open position and thereby allow fluid communication between the bore 12 of hydraulic cycle opening sleeve 10 and the surrounding wellbore (not shown). When in the closed position, aperture 58 on opening piston 46 is not aligned with apertures 54, 56 of port housing 42 and mandrel 44, and fluid communication is not allowed. Port housing 42, mandrel 44, and opening piston 46 may include one or more seals 60 to, for example, assist with preventing fluid flow when in the closed position, as well as with retaining fluid pressure within opening cylinder 48.

The pressure of the fluid within opening cylinder 48 is controlled by pressure within bore 12 as controlled by valve assembly 22 within valve collar 20. FIGS. 3A-3C and 4A-4C depict a valve assembly 22 consistent with at least one embodiment of the present disclosure. In one embodiment, valve collar 20 includes a valve cylinder 101. Valve cylinder 101 is connected to bore 12 of valve collar 20 by cycling port 103 and actuating port 105. Valve cylinder 101 is also fluidly connected to output port 107. Output port 107 may be fluidly connected with opening port 108, which is formed in valve collar 20, and continues through port housing 42 to opening cylinder 48 (not shown). One having ordinary skill in the art with the benefit of this disclosure will understand that a check valve (not shown) may be included in opening port 108 to prevent, for example, fluid from returning through opening port 108 from opening cylinder 48.

Figure 3A:
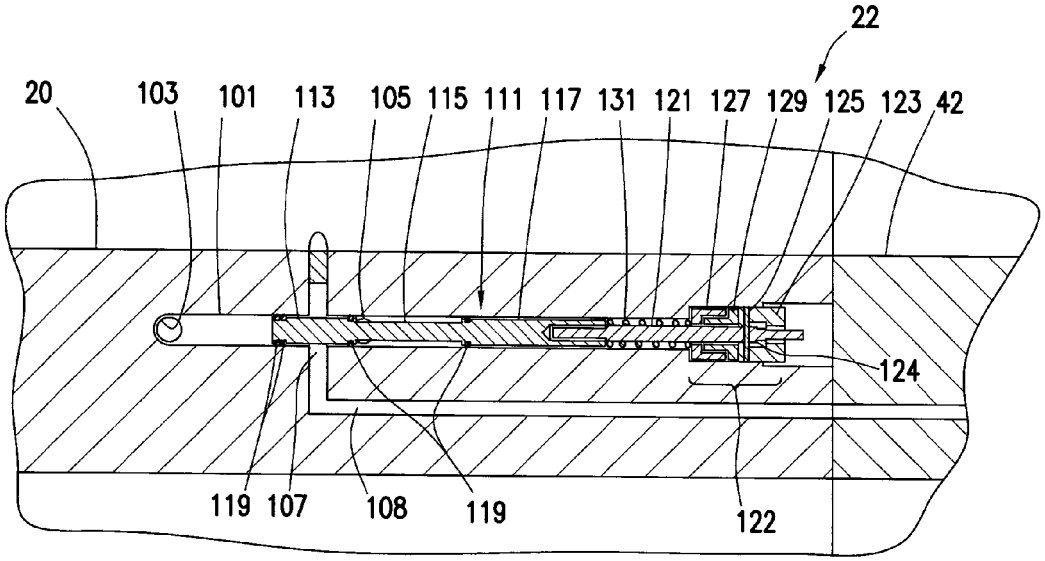
FIG. 3A is cross section view of a valve cylinder of a hydraulic cycle opening sleeve in a run-in position consistent with at least one embodiment of the present disclosure.
Figure 3B:
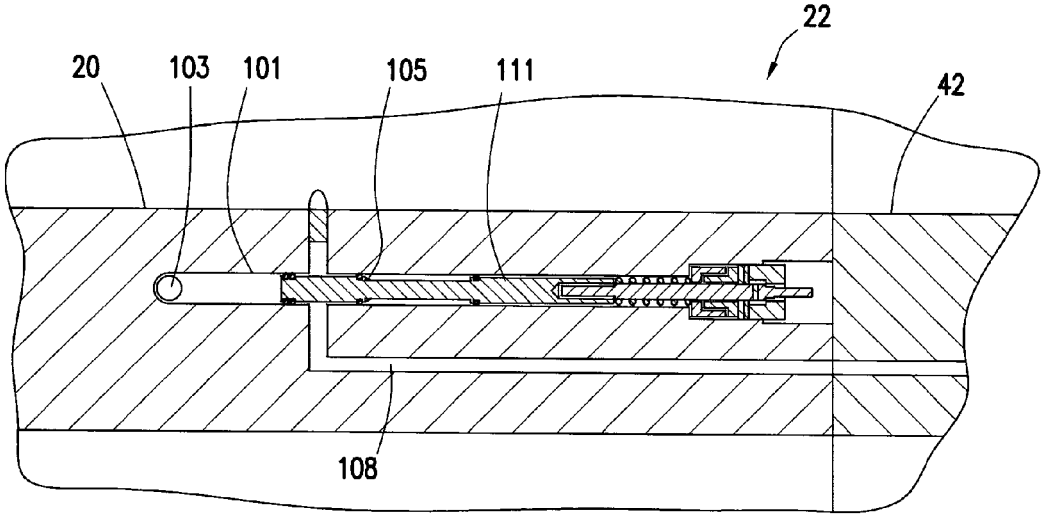
FIG. 3B is a cross section view of a valve cylinder of a hydraulic cycle opening sleeve in a test position consistent with at least one embodiment of the present disclosure.
Figure 3C:
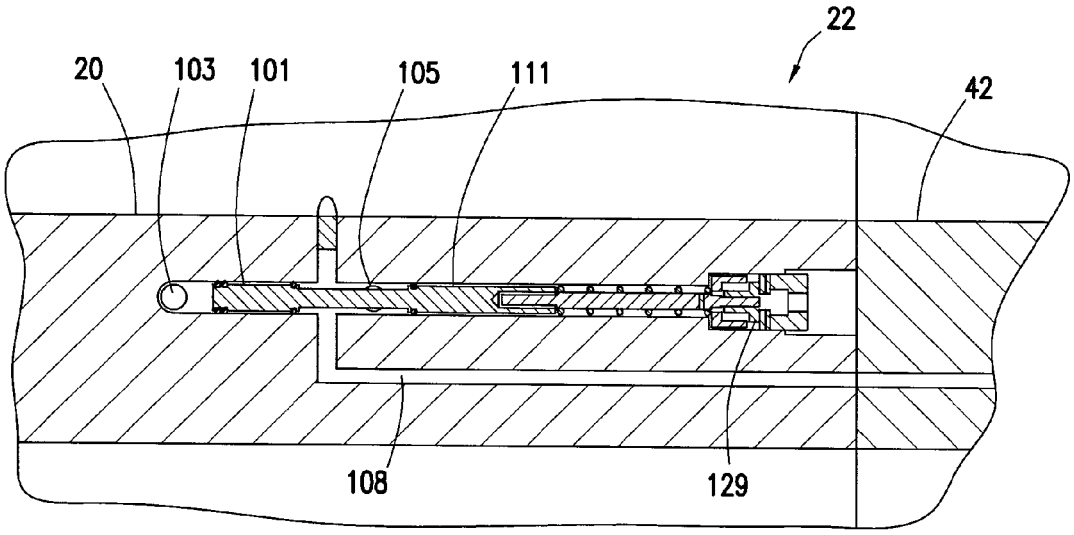
FIG. 3C is a cross section view of a valve cylinder of a hydraulic cycle opening sleeve in an open position consistent with at least one embodiment of the present disclosure.
Figure 4A:
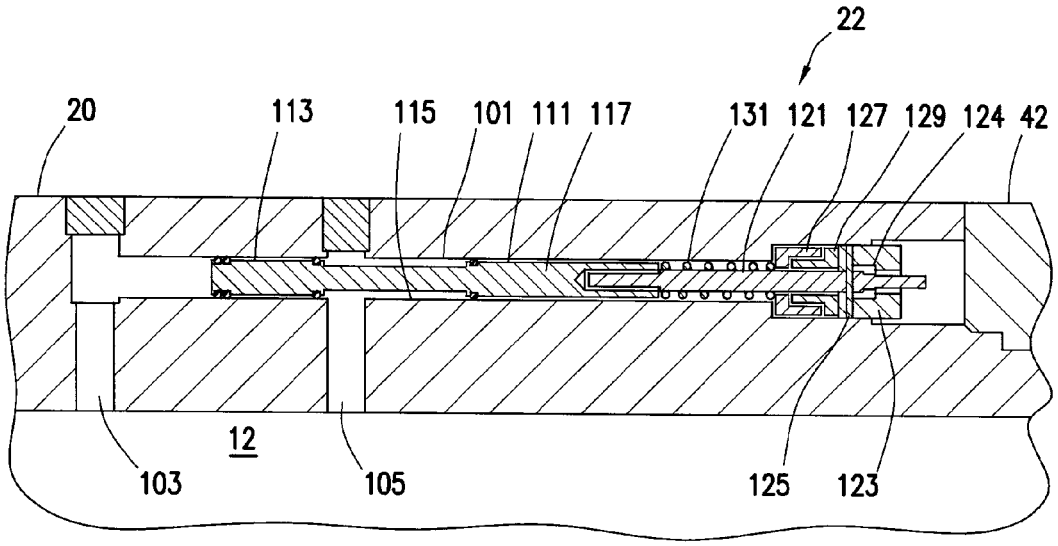
FIG. 4A is section view of the valve cylinder of the hydraulic cycle opening sleeve of FIG. 3A in a plane through the valve cylinder orthogonal to that of FIG. 3A.
Figure 4B:
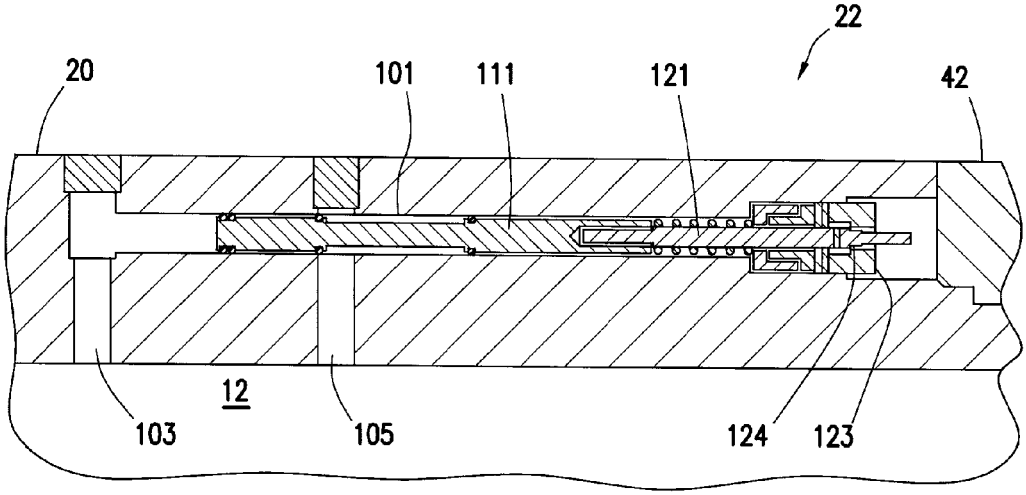
FIG. 4B is section view of the valve cylinder of the hydraulic cycle opening sleeve of FIG. 3B in a plane through the valve cylinder orthogonal to that of FIG. 3B.
Figure 4C:
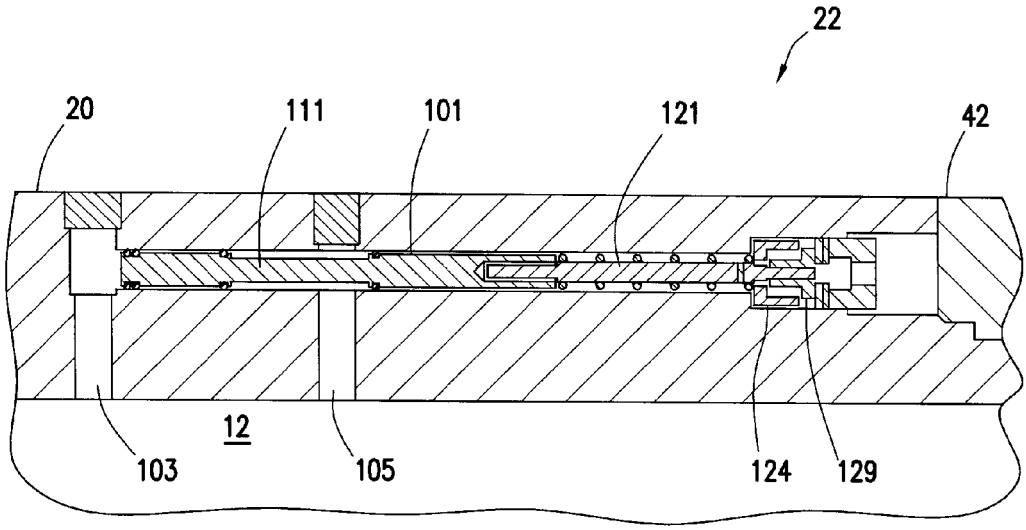
FIG. 4C is section view of the valve cylinder of the hydraulic cycle opening sleeve of FIG. 3C in a plane through the valve cylinder orthogonal to that of FIG. 3C.

Valve piston 111 is positioned within valve cylinder 101. Valve piston 111 includes piston head 113, bypass shank 115, and piston body 117. Piston head 113 is positioned to form a seal within valve cylinder 101 from fluid introduced into valve cylinder 101 from cycling port 103. Fluid entering from cycling port 103 may press against piston head 113 and cause valve piston 111 to move along valve cylinder 101. Piston head 113 may further selectively prevent fluid communication between actuating port 105 and opening port 107 when valve piston 111 is in the run in position (as depicted in FIGS. 3A, 4A) and the test position (FIGS. 3B, 4B), while allowing fluid communication when valve piston 111 is in the open position (FIGS. 3C, 4C). In the open position, bypass shank 115, depicted as having a smaller diameter than piston head 113 and piston body 117, is aligned in such a way as to permit a flow path between actuating port 105 and opening port 107. One having ordinary skill in the art with the benefit of this disclosure will understand that the specific structure of valve piston 111 may vary within the scope of this disclosure. Valve piston may include one or more seals 119 to assist with the sealing functions. One having ordinary skill in the art with the benefit of this disclosure will understand that the geometry of opening port 107 may vary within the scope of this disclosure. For example, opening port 107 may be formed as an integral flow path within valve piston 111.

Valve piston 111 is coupled to lock rod 121 at the end of piston body 117 opposite piston head 113. Lock rod 121 continues through valve cylinder 101 and is held therein by a retention assembly 122. Retention assembly may include a retaining bolt 123, shear pin 125, collar 127, and locking assembly. Retaining bolt 123 may be coupled to valve collar 20, and may include an aperture through which lock rod 121 may pass. Lock rod 121 may include a locking feature, such as a lip 124 which limits the throw of valve piston 111 and lock rod 121 within valve cylinder 101 by, for example, abutting against retaining bolt 123. Shear pin 125 may be included to retain valve piston 111 and lock rod 121 in the run-in position until sheared. Shear pin 125 may pass through retaining bolt 123 and lock rod 121. Lock rod 121 may also pass through collar 127, positioned to orient lock rod 121 within valve cylinder 101. Lock rod 121 may also pass through a locking assembly. Here, the locking assembly is depicted as having teeth 129, positioned within retaining bolt 123 positioned to engage with lip 124 by, for example, spring tension or geometry, to retain valve piston 111 and lock rod 121 in the open position once opened (FIGS. 3C, 4C). One having ordinary skill in the art with the benefit of this disclosure will understand that the locking assembly may be any suitable assembly to prevent piston 111 and lock rod 121 in the open position without deviating from the scope of this disclosure. Spring 131 may also be included to bias piston 111 and lock rod 121 into the open position once shear pin 125 has been sheared. Piston 111 will not be shifted into the open position by spring 131 until the pressure is bled from valve cylinder 101.

In operation, hydraulic cycle opening sleeve 10 may be run into a wellbore as part of a downhole tubular. Hydraulic cycle opening sleeve 10 is inserted into the wellbore in the run-in position, i.e. aperture 58 of opening piston 46 is not aligned with apertures 54, 56 of port housing 42 and mandrel 44 (FIG. 2A). Likewise, valve piston 111 is retained in the run-in position (FIGS. 3A, 4A). During a first pressure cycle, such as a pressure test, the bore of the downhole tubular—including bore 12 of hydraulic cycle opening sleeve 10—is fluidly pressurized for a time period. For example, a pressure test may be used to test the integrity of the downhole tubular within the wellbore before high-pressure operations are commenced. Since the opening of hydraulic cycle opening sleeve 10 would compromise the integrity, valve assembly 22 prevents the opening thereof during a pressure test. Fluid is prevented from entering opening cylinder 48 via opening port 108 by valve piston 111.

During the pressure cycle, fluid pressure is exerted on piston head 113 via cycling port 103. Valve cylinder 101 may include an aperture 133 (FIG. 2A) to the surrounding wellbore to allow the fluid pressure to unbalance the pressure exerted on valve piston 111. When sufficient force has been exerted on shear pin 125 via valve piston 111 and lock rod 121, shear pin 125 will shear, allowing piston 111 and lock rod 121 to move within valve chamber 101 to the test position (FIGS. 3B, 4B). In the test position, fluid is still prevented from entering opening cylinder 48 via opening port 108 by valve piston 111. Fluid pressure against piston head 113 retains valve piston 111 in the test position during the entire pressure cycle.

At the completion of the pressure cycle, pressure is bled off. As the pressure decreases, spring 131 may force valve piston 111 and lock rod 121 back through valve cylinder 101. When lip 124 of lock rod 121 passes the locking assembly 122, teeth 129 engage lip 124, thereby locking valve piston 111 in the open position (FIGS. 3C, 4C). Spring 131 forces valve piston 111 further into valve cylinder 101 than the run in position, thereby opening fluid communication between actuating port 105 and output port 107.

During a subsequent pressure cycle, fluid pressure on piston head 113 via actuating port 103 is resisted by locking assembly 122, preventing valve piston 111 from leaving the open position. With valve piston 111 in the open position, fluid pressure from bore 12 may act on opening piston 46 via output port 107 and opening port 108. Regarding FIG. 2A, when sufficient force has been exerted on shear bolt 50, shear bolt 50 will shear. Opening piston 46 moves along opening cylinder 48, and opening piston 46 moves into the open position FIG. 2B. Fluid communication is thereby established between bore 12 and the surrounding wellbore. Spring 52 may likewise bias opening position 46 into the open position.

Figure 5:
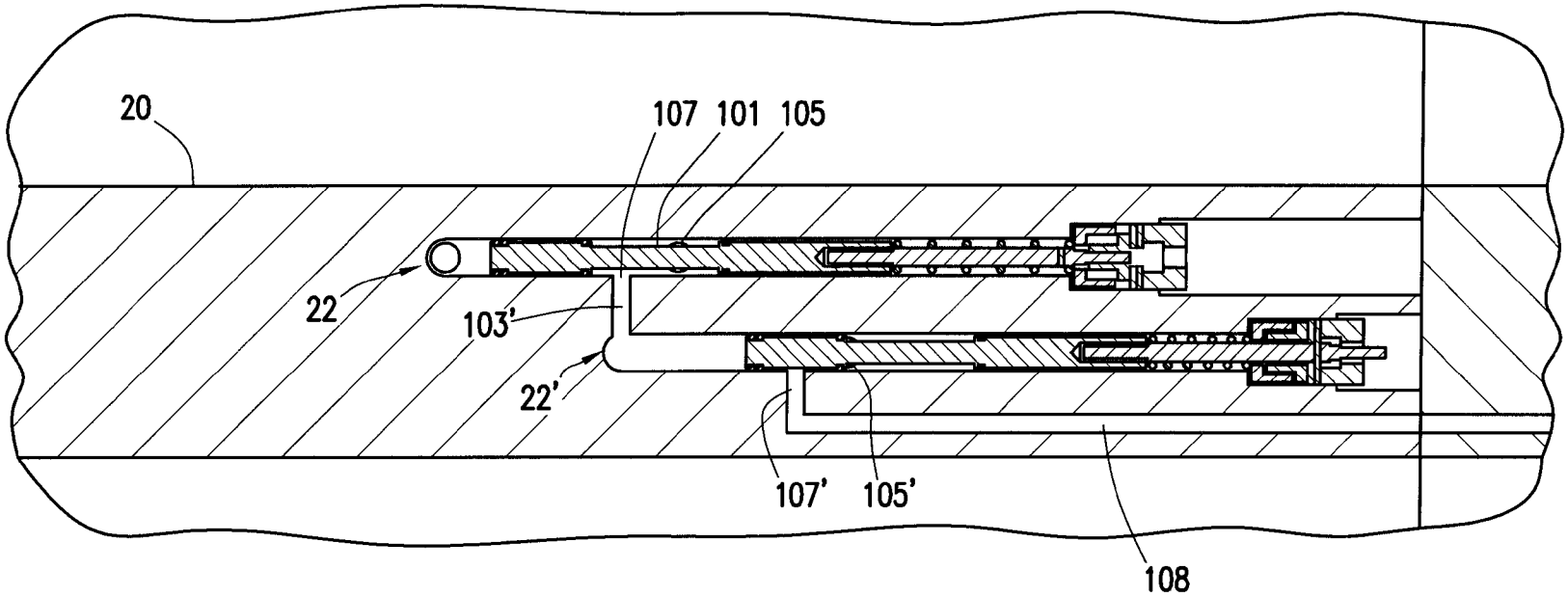
FIG. 5 is a section view of a twin-valve cylinder arrangement in a hydraulic cycle opening sleeve consistent with at least one embodiment of the present disclosure.

In some embodiments of the present disclosure, a second valve assembly 22' may be included in valve collar 20 as depicted in FIG. 5. Second valve assembly 22' may be coupled to the first valve assembly 22 through the output port 107 of first valve assembly 22, and may operate in the same manner as the first valve assembly 22, with output port 107 acting as cycling port 103' of second valve assembly 22'. Output port 107' of second valve assembly 22' may be connected to opening port 108. FIG. 5 depicts first valve assembly 22 in the open position and second valve assembly 22' in the closed position. One having ordinary skill in the art with the benefit of this disclosure will likewise understand that the layout of the first and second valve assemblies 22, 22' and the port configuration therebetween may be other than depicted.

As depicted in FIG. 5, the first pressure test cycle has occurred and pressure has been bled. First valve assembly 22 is therefore in the open position, thereby opening fluid communication between the bore of hydraulic cycle opening sleeve 10 to valve chamber 101' of second valve assembly 22' via actuating port 105, valve chamber 101, output port 107 and cycling port 103'. Second valve assembly 22' is still in the run in configuration. Therefore, a second pressure test cycle is possible before hydraulic cycle opening sleeve 10 will be opened.

Figure 6:
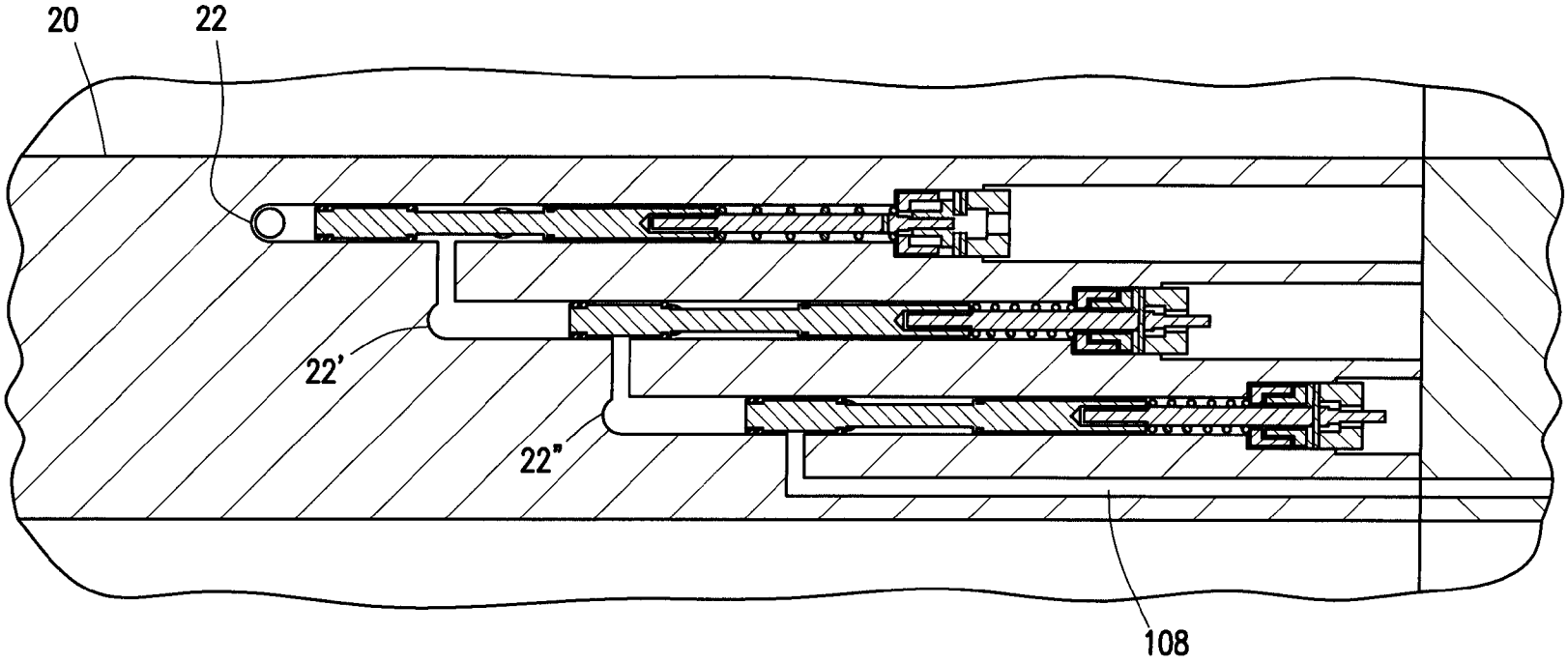
FIG. 6 is a section view of a three-valve cylinder arrangement in a hydraulic cycle opening sleeve consistent with at least one embodiment of the present disclosure.

One having ordinary skill in the art with the benefit of this disclosure will understand that any number of valve assemblies, given the physical constraints of the valve collar 20, may be included in valve collar 20 in such an arrangement to increase the number of test pressure cycles available before opening piston 46 is actuated. For example, in FIG. 6, a third valve assembly 22" is included in valve collar 20. Thus three pressure test cycles must be performed before hydraulic cycle opening sleeve 10 will be opened.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

What is claimed is:

1. A hydraulic cycle opening sleeve comprising:

a valve collar, the valve collar being a generally tubular member, the valve collar including a first valve cylinder formed in the wall of the valve collar, the first valve cylinder including a first cycling port, a first actuating port, and a first output port; the valve collar including an opening port;

a first valve piston positioned to slide within the first valve cylinder in response to fluid pressure introduced into the first valve cylinder through the first cycling port, the first valve piston positioned to fluidly disconnect the first actuating port and the first output port when the first valve piston is in the run in and test positions and positioned to allow fluid connection between the first actuating port and the first output port when the first valve piston is in the open position, the output port fluidly coupled directly or indirectly to the opening port;

a first lock rod positioned substantially within the first valve cylinder, the first lock rod coupled to the first valve piston, the first lock rod including at least one locking feature positioned to retain the first valve piston in the open position once the first valve piston is in the open position, the locking feature being a lip formed in the outer surface of the first lock rod, the locking feature adapted to interlock with one or more teeth coupled to the valve collar, the first lock rod including a shear pin hole positioned to accept:

a first shear pin coupled to the valve collar, the first shear pin adapted to resist movement of the first valve piston until a selected fluid pressure introduced into the first valve cylinder through the first cycling port causes the first shear pin to shear;

a first valve spring positioned within the first valve cylinder positioned to bias the first valve piston into the open position;

a generally tubular mandrel coupled to the valve collar forming a continuous fluidly connected bore, the mandrel including a mandrel aperture from the interior of the mandrel to the exterior of the mandrel;

a generally tubular port housing coupled to the valve collar, the port housing defining an opening cylinder between an inner wall of the port housing and the exterior cylindrical surface of the mandrel, the opening cylinder fluidly coupled to the opening port of the valve collar, the port housing including a housing aperture from the interior of the port housing to the surrounding wellbore positioned to substantially align with the mandrel aperture of the mandrel; and an opening piston positioned to slide about the mandrel, the piston positioned to slide within the opening cylinder in response to fluid pressure within the opening cylinder when fluid pressure is introduced therein via the opening port of the valve collar, the opening piston including at least one piston aperture, the body of the opening piston positioned to selectively disconnect the mandrel aperture from the housing aperture when in the run-in position, thereby preventing fluid communication between the bore of the mandrel and the surrounding wellbore, and the piston aperture in substantial alignment with the mandrel aperture and housing aperture when in the open position thereby allowing fluid communication between the bore of the mandrel and the surrounding wellbore.

2. The hydraulic cycle opening sleeve of claim 1, further comprising an opening shear bolt positioned to retain the opening piston in the run-in position until sufficient pressure within the opening cylinder is applied to shear the shear bolt.

3. The hydraulic cycle opening sleeve of claim 2, further comprising an opening spring positioned to bias the opening piston into the open position once the shear bolt is sheared, and maintain the opening piston in the open position when pressure within the opening cylinder is bled.

4. The hydraulic cycle opening sleeve of claim 1, wherein the first cycling port and the first actuating port are fluidly coupled to the bore of the valve collar.

5. The hydraulic cycle opening sleeve of claim 1, wherein the valve collar further comprises:

a second valve cylinder formed in the wall of the valve collar, the second valve cylinder including a second cycling port, a second actuating port, and a second output port, the second cycling port fluidly coupled to the first output port of the first valve cylinder, and the second output port coupled to the opening port;

a second valve piston positioned to slide within the second valve cylinder in response to fluid pressure introduced into the second valve cylinder through the second cycling port, the second valve piston positioned to fluidly disconnect the second actuating port and the second output port when the second valve piston is in the run in and test positions and positioned to allow fluid connection between the second actuating port and the second output port when the second valve piston is in the open position;

a second lock rod positioned substantially within the second valve cylinder, the second lock rod coupled to the second valve piston, the second lock rod including at least one second locking feature positioned to retain the second valve piston in the open position once the second valve piston is in the open position, the second lock rod including a shear pin hole positioned to accept:

a second shear pin coupled to the valve collar, the second shear pin adapted to resist movement of the second valve piston until a selected fluid pressure introduced into the second valve cylinder through the second cycling port causes the second shear pin to shear;

a second valve spring positioned within the second valve cylinder positioned to bias the second valve piston into the open position.

6. A method comprising:

providing a downhole tubular, the downhole tubular including a hydraulic cycle opening sleeve including:

a valve collar, the valve collar being a generally tubular member, the valve collar including a first valve cylinder formed in the wall of the valve collar, the first valve cylinder including a first cycling port, a first actuating port, and a first output port; the valve collar including an opening port;

a first valve piston positioned to slide within the first valve cylinder in response to fluid pressure introduced into the first valve cylinder through the first cycling port, the first valve piston positioned to fluidly disconnect the first actuating port and the first output port when the first valve piston is in a run in position and a test position and positioned to allow fluid connection between the first actuating port and the first output port when the first valve piston is in the open position, the output port fluidly coupled directly or indirectly to the opening port;

a first lock rod positioned substantially within the first valve cylinder, the first lock rod coupled to the first valve piston, the first lock rod including at least one locking feature positioned to retain the first valve piston in the open position once the first valve piston is in the open position, the first lock rod including a shear pin hole positioned to accept:

a first shear pin coupled to the valve collar, the first shear pin adapted to resist movement of the first valve piston until a selected fluid pressure introduced into the first valve cylinder through the first cycling port causes the first shear pin to shear;

a first valve spring positioned within the first valve cylinder positioned to bias the first valve piston into the open position;

a generally tubular mandrel coupled to the valve collar forming a continuous fluidly connected bore, the mandrel including a mandrel aperture from the interior of the mandrel to the exterior of the mandrel;

a generally tubular port housing coupled to the valve collar, the port housing defining an opening cylinder between an inner wall of the port housing and the exterior cylindrical surface of the mandrel, the opening cylinder fluidly coupled to the opening port of the valve collar, the port housing including a housing aperture from the interior of the port housing to the surrounding wellbore positioned to substantially align with the mandrel aperture; and an opening piston positioned to slide about the mandrel, the piston positioned to slide within the opening cylinder in response to fluid pressure within the opening cylinder when fluid pressure is introduced therein via the opening port of the valve collar, the opening piston including at least one piston aperture, the body of the opening piston positioned to selectively disconnect the mandrel aperture from the housing aperture when in the run-in position, thereby preventing fluid communication between the bore of the mandrel and the surrounding wellbore, and the piston aperture in substantial alignment with the mandrel aperture and housing aperture when in the open position thereby allowing fluid communication between the bore of the mandrel and the surrounding wellbore;

running the downhole tubular into a wellbore;

pressurizing the bore of the downhole tubular in a first pressure test cycle, so that the first valve piston shears the first shear pin, causing the first valve piston to move from the run in position to the test position;

bleeding the pressure from the bore of the downhole tubular, so that the first valve spring forces the first valve piston into the open position, and the first locking feature retains the first valve piston in the open position;

pressurizing the bore of the downhole tubular, so that fluid flows through the first actuating port, the first valve cylinder, the first output port, and the opening port so that the opening piston moves into the open position.

7. The method of claim 6, wherein the hydraulic cycle opening sleeve further comprises an opening shear bolt positioned to retain the opening piston in the run-in position until sufficient pressure within the opening cylinder is applied to shear the shear bolt.

8. The method of claim 7, wherein the hydraulic cycle opening sleeve further comprises an opening spring positioned to bias the opening piston into the open position once the shear bolt is sheared, and maintain the opening piston in the open position when pressure within the opening cylinder is bled.

9. The method of claim 6, wherein:

the valve cylinder further comprises:

a second valve cylinder formed in the wall of the valve collar, the second valve cylinder including a second cycling port, a second actuating port, and a second output port, the second cycling port fluidly coupled to the first output port of the first valve cylinder, and the second output port coupled to the opening port;

a second valve piston positioned to slide within the second valve cylinder in response to fluid pressure introduced into the second valve cylinder through the second cycling port, the second valve piston positioned to fluidly disconnect the second actuating port and the second output port when the second valve piston is in the run in and test positions and positioned to allow fluid connection between the second actuating port and the second output port when the second valve piston is in the open position;

a second lock rod positioned substantially within the second valve cylinder, the second lock rod coupled to the second valve piston, the second lock rod including at least one second locking feature positioned to retain the second valve piston in the open position once the second valve piston is in the open position, the second lock rod including a shear pin hole positioned to accept:

a second shear pin coupled to the valve collar, the second shear pin adapted to resist movement of the second valve piston until a selected fluid pressure introduced into the second valve cylinder through the second cycling port causes the second shear pin to shear;

a second valve spring positioned within the second valve cylinder positioned to bias the second valve piston into the open position; and the method further comprises:

pressurizing the bore of the downhole tubular in a second pressure test cycle, so that the second valve piston shears the second shear pin, causing the second valve piston to move from the run in position to the test position;

bleeding the pressure from the bore of the downhole tubular, so that the second valve spring forces the second valve piston into the open position, and the second locking feature retains the second valve piston in the open position; and the fluid flows through the second actuating port, the second valve cylinder, and the second output port.

10. A hydraulic cycle opening sleeve comprising:

a valve collar, the valve collar being a generally tubular member, the valve collar including a first valve cylinder formed in the wall of the valve collar, the first valve cylinder including a first cycling port, a first actuating port, and a first output port; the valve collar including an opening port;

a first valve piston positioned to slide within the first valve cylinder in response to fluid pressure introduced into the first valve cylinder through the first cycling port, the first valve piston positioned to fluidly disconnect the first actuating port and the first output port when the first valve piston is in the run in and test positions and positioned to allow fluid connection between the first actuating port and the first output port when the first valve piston is in the open position, the output port fluidly coupled directly or indirectly to the opening port;

a first lock rod positioned substantially within the first valve cylinder, the first lock rod coupled to the first valve piston, the first lock rod including at least one locking feature positioned to retain the first valve piston in the open position once the first valve piston is in the open position, the first lock rod including a shear pin hole positioned to accept:

a first shear pin coupled to the valve collar, the first shear pin adapted to resist movement of the first valve piston until a selected fluid pressure introduced into the first valve cylinder through the first cycling port causes the first shear pin to shear;

a first valve spring positioned within the first valve cylinder positioned to bias the first valve piston into the open position;

a second valve cylinder formed in the wall of the valve collar, the second valve cylinder including a second cycling port, a second actuating port, and a second output port, the second cycling port fluidly coupled to the first output port of the first valve cylinder, and the second output port coupled to the opening port;

a second valve piston positioned to slide within the second valve cylinder in response to fluid pressure introduced into the second valve cylinder through the second cycling port, the second valve piston positioned to fluidly disconnect the second actuating port and the second output port when the second valve piston is in the run in and test positions and positioned to allow fluid connection between the second actuating port and the second output port when the second valve piston is in the open position;

a second lock rod positioned substantially within the second valve cylinder, the second lock rod coupled to the second valve piston, the second lock rod including at least one second locking feature positioned to retain the second valve piston in the open position once the second valve piston is in the open position, the second lock rod including a shear pin hole positioned to accept:

a second shear pin coupled to the valve collar, the second shear pin adapted to resist movement of the second valve piston until a selected fluid pressure introduced into the second valve cylinder through the second cycling port causes the second shear pin to shear;

a second valve spring positioned within the second valve cylinder positioned to bias the second valve piston into the open position;

a generally tubular mandrel coupled to the valve collar forming a continuous fluidly connected bore, the mandrel including a mandrel aperture from the interior of the mandrel to the exterior of the mandrel;

a generally tubular port housing coupled to the valve collar, the port housing defining an opening cylinder between an inner wall of the port housing and the exterior cylindrical surface of the mandrel, the opening cylinder fluidly coupled to the opening port of the valve collar, the port housing including a housing aperture from the interior of the port housing to the surrounding wellbore positioned to substantially align with the mandrel aperture of the mandrel; and an opening piston positioned to slide about the mandrel, the piston positioned to slide within the opening cylinder in response to fluid pressure within the opening cylinder when fluid pressure is introduced therein via the opening port of the valve collar, the opening piston including at least one piston aperture, the body of the opening piston positioned to selectively disconnect the mandrel aperture from the housing aperture when in the run-in position, thereby preventing fluid communication between the bore of the mandrel and the surrounding wellbore, and the piston aperture in substantial alignment with the mandrel aperture and housing aperture when in the open position thereby allowing fluid communication between the bore of the mandrel and the surrounding wellbore.

11. The hydraulic cycle opening sleeve of claim 10, further comprising an opening shear bolt positioned to retain the opening piston in the run-in position until sufficient pressure within the opening cylinder is applied to shear the shear bolt.

12. The hydraulic cycle opening sleeve of claim 11, further comprising an opening spring positioned to bias the opening piston into the open position once the shear bolt is sheared, and maintain the opening piston in the open position when pressure within the opening cylinder is bled.

13. The hydraulic cycle opening sleeve of claim 10, wherein the locking feature of the first lock rod is a lip formed in the outer surface of the first lock rod and is adapted to interlock with one or more teeth coupled to the valve collar.

14. The hydraulic cycle opening sleeve of claim 10, wherein the first cycling port and the first actuating port are fluidly coupled to the bore of the valve collar.

* * * * *